US005704123A

United States Patent [19]

Paulman et al.

[11] Patent Number: 5,704,123

[45] Date of Patent: Jan. 6, 1998

[54] METHOD OF MAKING FOLDED, BENT AND RE-EXPANDED HEAT EXCHANGER TUBE AND ASSEMBLIES

[75] Inventors: Roger Paulman, Barrington; A. Todd McKay, Matteson, both of Ill.

[73] Assignee: Peerless of America, Incorporated, Aptakisic, Ill.

[21] Appl. No.: 572,180

[22] Filed: Dec. 13, 1995

Related U.S. Application Data

[60] Provisional application No. 60/006,655 Nov. 13, 1995.

[51] Int. Cl.[6] ..... B23P 15/26

[52] U.S. Cl. ..... 29/890.053; 29/890.047; 165/150

[58] Field of Search ..... 29/890.047, 890.044, 29/890.043, 890.53; 165/150

[56] References Cited

U.S. PATENT DOCUMENTS

| | | | |
|---|---|---|---|
| 2,689,596 | 9/1954 | Huet | 29/890.053 |
| 3,780,799 | 12/1973 | Pasternak | 29/890.047 |
| 3,796,258 | 3/1974 | Malhotra et al. | 29/890.047 |
| 4,031,745 | 6/1977 | McCarty | 29/890.053 |
| 4,365,667 | 12/1982 | Hatada et al. | 29/840.047 |
| 4,778,004 | 10/1988 | Paulman et al. . | |
| 4,881,311 | 11/1989 | Paulman et al. . | |
| 4,970,770 | 11/1990 | Jansson et al. | 29/840.047 |
| 5,154,679 | 10/1992 | Fuller et al. | 29/890.043 |
| 5,228,198 | 7/1993 | Paulman et al. . | |
| 5,535,820 | 7/1996 | Beagle et al. | 29/890.047 |

*Primary Examiner*—Irene Cuda

*Attorney, Agent, or Firm*—Hill, Steadman & Simpson

[57] ABSTRACT

A heat exchanger assembly of the side-entry type includes at least one fin set and an elongated heat exchanger tube having a collapsed sidewall extending substantially the length of the tube which permits the bending of the elongated heat exchanger tube at the return bend portions and permits expansion of the elongated tube to engage the fin set. Method and apparatus for making the elongated heat exchanger tube having the collapsed sidewall substantially extending the length of the tube as well as methods of making heat exchanger assemblies.

30 Claims, 5 Drawing Sheets

METHOD OF MAKING FOLDED, BENT AND RE-EXPANDED HEAT EXCHANGER TUBE AND ASSEMBLIES

BACKGROUND OF THE INVENTION

This application is being filed based on Provisional application Ser. No. 60,006,655 filed on Nov. 10, 1995, entitled FOLDED, BENT AND RE-EXPANDED HEAT EXCHANGER TUBE AND ASSEMBLIES.

The present invention relates to a novel thin-walled heat exchanger tube and a method of manufacturing heat exchanger assemblies utilizing such thin-walled heat exchanger tubes.

Aluminum evaporator coils have been used for decades in frost-free refrigeration systems. Their adoption and use has been predicated upon cost-effective manufacturing methods relative to competing technologies, coupled with continued improvements in operating efficiencies and the use of less refrigerant material in the refrigeration system. For example, the tube wall thickness has typically declined from about 0.035 inches to approximately 0.019 inches over the past twenty years. Additionally, fin thicknesses have also been typically reduced from 0.010 to 0.00575 inches during this same period of time. Such savings in material wall thickness has been possible because the finished evaporator coil generally requires a burst strength of only about 500 pounds per square inch maximum while current models even with the thinnest tube wall-thicknesses possess burst strengths of over 1,000 pounds per square inch, more than a sufficient safety factor.

However, the problem facing heat exchanger assembly manufacturers has been to devise an acceptable method of manufacturing a coil using thin-walled tubing. The problem of the known prior art methods is highlighted by the requirement of bending the thin-walled tubing around a small radius to create the "return bend." Thin-walled tubing collapses unless properly supported either internally with a mandrel bend, which is now uneconomic because of cleanliness requirements of the new refrigerants, or externally by spacers as has been the case for many years in the manufacture of this style of evaporator coil. In addition, some methods of manufacture require that the thin-walled tubing be pushed or pulled through collared fins sets or arrays. Because thin-walled heat exchanger tubes do not possess sufficient strength and rigidity, they are generally unsuitable for this type of handling in manufacture.

Various means have been suggested for containing the thin-walled heat exchange tube at the "return bend." One such method utilizes spacers as the tube is wound around a mandrel thereby resulting in a controlled collapse of the tubing at the return bend that is later expanded through internal pressure to something close to its original size and shape. See for example, U.S. Pat. No. 5,228,198, assigned to the assignee of the present invention for a discussion of the technique. Alternately, it has been suggested that the heat exchanger tubing may be ovalized in cross-section to fit into keyhole shaped slots in the fin set or array which are then re-expanded through the use of internal pressure. See for example, U.S. Pat. Nos. 4,778,004 and 4,881,311 assigned to the assignee of the present invention for such techniques. However, each of these methods result in return bend portions that must be externally supported to prevent collapse of the tube.

SUMMARY OF THE INVENTION

Therefore, one object of the present invention is to provide a novel method of making and utilizing a thin-walled elongated heat exchanger tube having a collapsed side-wall extending substantially the length thereof in a heat exchanger assembly of the side-entry type which may be readily manufactured and assembled.

Another object of the present invention is to provide a thin-walled heat exchanger assembly which is more compact and rugged than existing heat exchanger assemblies while possessing increased efficiencies over existing refrigeration systems.

It is another object of the present invention to permit easy assembly and positioning of the serpentine tube into the associated fin set without the use of collars or other devices.

It is still another object of the present invention to utilize a novel heat exchanger tube arrangement wherein a thin-walled elongated tube having a collapsed side wall extending substantially the length thereof is inserted within a straight tube of a larger diameter and then reinflated to form a tight bond and seal with the outside tube to provide a shield for the interior tube against leakage. This permits the use of such heat exchanger assemblies in refrigeration systems containing combustible refrigerants.

It is yet another object of the present invention to provide a novel heat exchanger tube wherein a heating wire is positioned within the elongated opening of the collapsed tube, the tube and heating wire is inserted within a straight tube of a larger diameter and then re-inflated to form a tight bond and seal with the outside tube to provide a structure where the heating wire contained between the heat exchanger tubes is positioned adjacent the fin sets or array to readily accomplish defrosting of the heat exchanger assembly.

In accordance with the present invention, a thin-walled heat exchanger tube is passed through a folding mechanism or Yoder style rolling mill to provide an elongated tube having a collapsed side-wall extending substantially the length of the tube. The cross-section of the collapsed elongated tube provides an elongated recess, channel or opening extending substantially the length of the heat exchanger tube. The effect of compressing or collapsing the tubing to create a recess or opening extending the length of the tubing provides that the effective diameter of the heat exchanger tube has been reduced while the effective tube-wall thickness has been increased. Such a tube structure permits the bending of the resilient tube having a smaller diameter about a mandrel with the folded wall preventing the collapse of the tubing in the bend area. Thus, by reducing the effective diameter of the tube while increasing the effective wall thickness of the tube, smaller mandrels may be used for bending the heat exchanger tube into the serpentine coil. This structure permits the bending of the collapsed tube having a wall thickness of as little as 0.014 inches or below around mandrels of ½ inch or less to provide a finish coil containing tubes as close together in the plane of bending of ½ inch or less instead of the ⅝ inches or greater, as is true of existing heat exchanger assemblies. This structure provides an increase of tube density in a given coil configuration of up to 20 per cent over existing structures, a significant factor in making heat exchanger assemblies.

Additionally, in accordance with the present invention, the inward folding of the elongated tube to provide a collapsed side wall extending substantially the length of the tube provides a collapsed tube where the interior surface of the fold actually touches or comes very close to touching or engaging the opposite wall of the tube. Such a structure prevents the portion of the tube that is in actual contact with the mandrels during the bending operation from forming a "cave" or "dent" by moving away from the mandrel. Such "caves" or "dents" generally do not re-round themselves during the reinflation of the tubing process. The opposite sidewall of the tube being in contact with the sidewall which engages the mandrel, has an effect of reinforcing the tube wall against such "caving" or "denting" during wrapping and, thus, increases the effective wall thickness for the purpose of bending.

During the manufacture of heat exchanger tubes in accordance with the present invention, at least one end of the heat exchanger tube for a distance of approximately 6 to 12 inches from the end is not collapsed during engagement with the folding mechanism or means and remains in the as-extruded round cross-sectional configuration. The round end structure facilitates ready attachment or connection with a pressure fitting when the time for reinflation occurs.

Thus, the present invention discloses a manufacturing method for making heat exchanger assemblies that eliminates the use of spacers during the bending operation of the heat exchanger tube around multiple diameter mandrel assemblies. Additionally, the present invention, utilizing a collapsed thin-walled heat exchanger tube, provides for a heat exchanger assembly having a more dense spacing of the tube utilizing smaller mandrel sizes than is presently available under existing prior art structures. Additionally, mandrels of differing sizes and greater design opportunities exist for use with the refrigeration industry thereby providing increased evaporator efficiency of the refrigerating system. Also, in accordance with the present invention, thinner fins and tube walls may be utilized than had previously been possible for use in making heat exchanger assemblies containing a serpentine elongated heat exchanger tube and results in a more efficient tube having a substantial lower cost in manufacturing.

Thus, the present invention significantly simplifies the tube bending mechanism utilized in serpentine-type heat exchanger assemblies while providing an initial lower investment in equipment costs to make heat exchanger assemblies in accordance with the present invention.

Also, the present invention allows for a much greater flexibility in the configuration and placement of heat exchanger tubes relative to the fin set and enables the designer to change concentration of tubes and fins within the same finished product.

The present invention consists of certain novel features and structural details hereinafter fully described, illustrated in the accompanying drawings, and particularly pointed out in the appended claims, it being understood that various changes in the details may be made without departing from the spirit, or sacrificing any of the advantages of the present invention.

DESCRIPTION OF THE DRAWINGS

For the purpose of facilitating and understanding the present invention, there is illustrated in the accompanying drawings a preferred embodiment thereof, from an inspection of which, when considered in connection with the following detailed description, the invention, its construction and operation, and many of its advantages will be readily understood and appreciated.

DETAILED DESCRIPTION OF THE INVENTION

Figure 1:
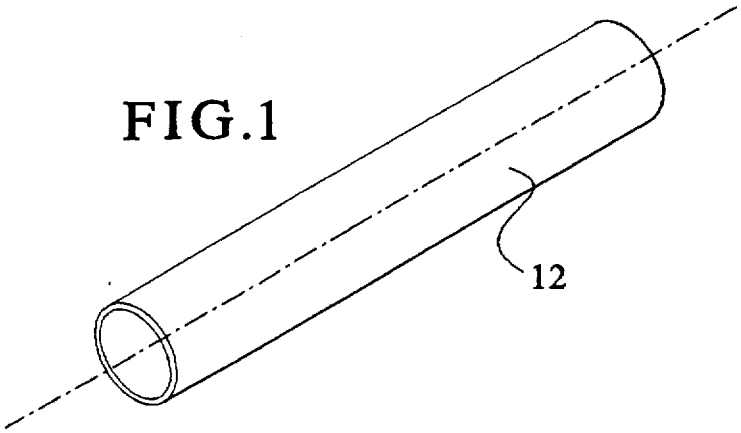
FIG. 1 is a perspective view of an extruded thin-walled heat exchanger tube in accordance with the present invention.
Figure 1A:
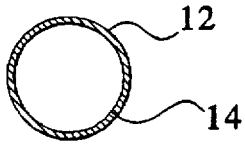
FIG. 1A is a cross-section of the thin-walled heat exchanger tube shown in FIG. 1.

Referring now to the drawings wherein like numerals have been used throughout the several views to identify the same or similar parts, the heat exchanger assembly 10 (FIG. 6) includes a one piece length of heat exchanger tubing 12 (FIGS. 1 and 1A) in the as-extruded round condition. The tubing 12 used for heat exchangers of the type used in home refrigerator systems typically have outside diameters of ¼ to ½ inch, with wall thicknesses 14 of between about 0.010 to 0.030 inches and calculated to provide a minimum burst strength. The wall thickness 14 will depend on the material selected for extrusion, such as AA1050 grade aluminum, and the tolerances allowed by the aluminum extrusion process. The tubing 12 at this stage is in the as-extruded round configuration or "F" state typically with a fine-grained structure.

The tubing 12 is cut to length for the particular serpentine configuration desired in the finished heat exchanger assembly with one length for each assembly. This length may vary typically from as little as 15 feet to as much as 50 feet, depending on the total heat transfer required by the refrigeration system.

Preferably, about 6–12 inches on the ends of the tubing are preserved in their as-extruded "round" state, as will hereinafter be discussed. One end of each individual tube is then inserted 6–12 inches from the end into a compression means or Yoder style rolling mill 15, as shown in FIGS. 2 and 3.

Figure 2:
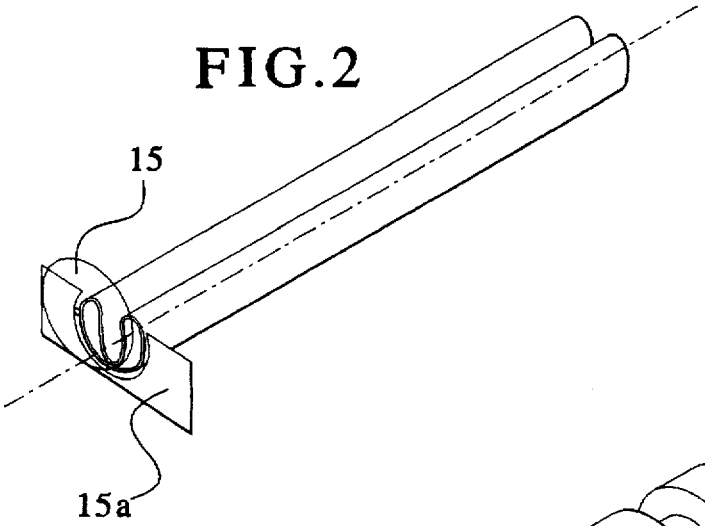
FIG. 2 is a perspective view of a collapsed thin-walled heat exchanger tube during rolling down through a folding mechanism or means of the exchanger tube of FIG. 1 to provide the elongated collapsed heat exchanger tube in accordance with the present invention.
Figure 2A:
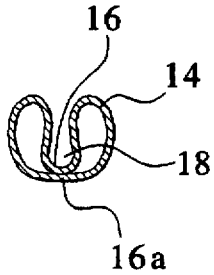
FIG. 2A is a front view of the heat exchanger tube passing through the folding mechanism as shown in FIG. 2.
Figure 3:
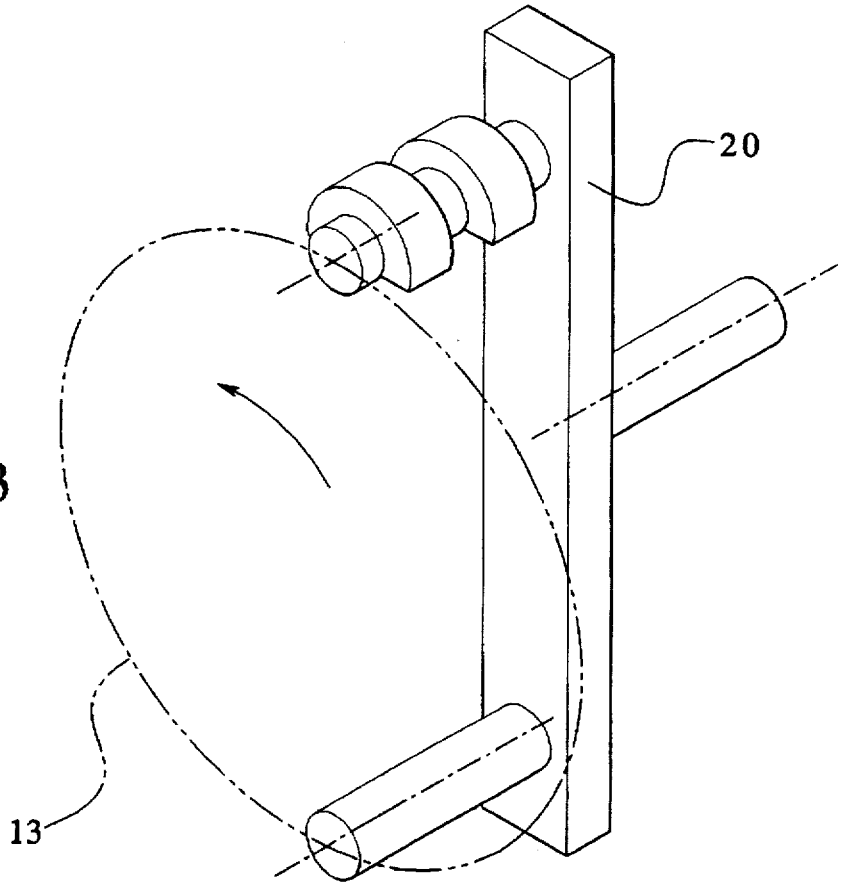
FIG. 3 illustrates a set of multiple diameter mandrels used for bending the various radii bends in a continuous wrapping motion for making the serpentine tube in accordance with the present invention.
Figure 4:
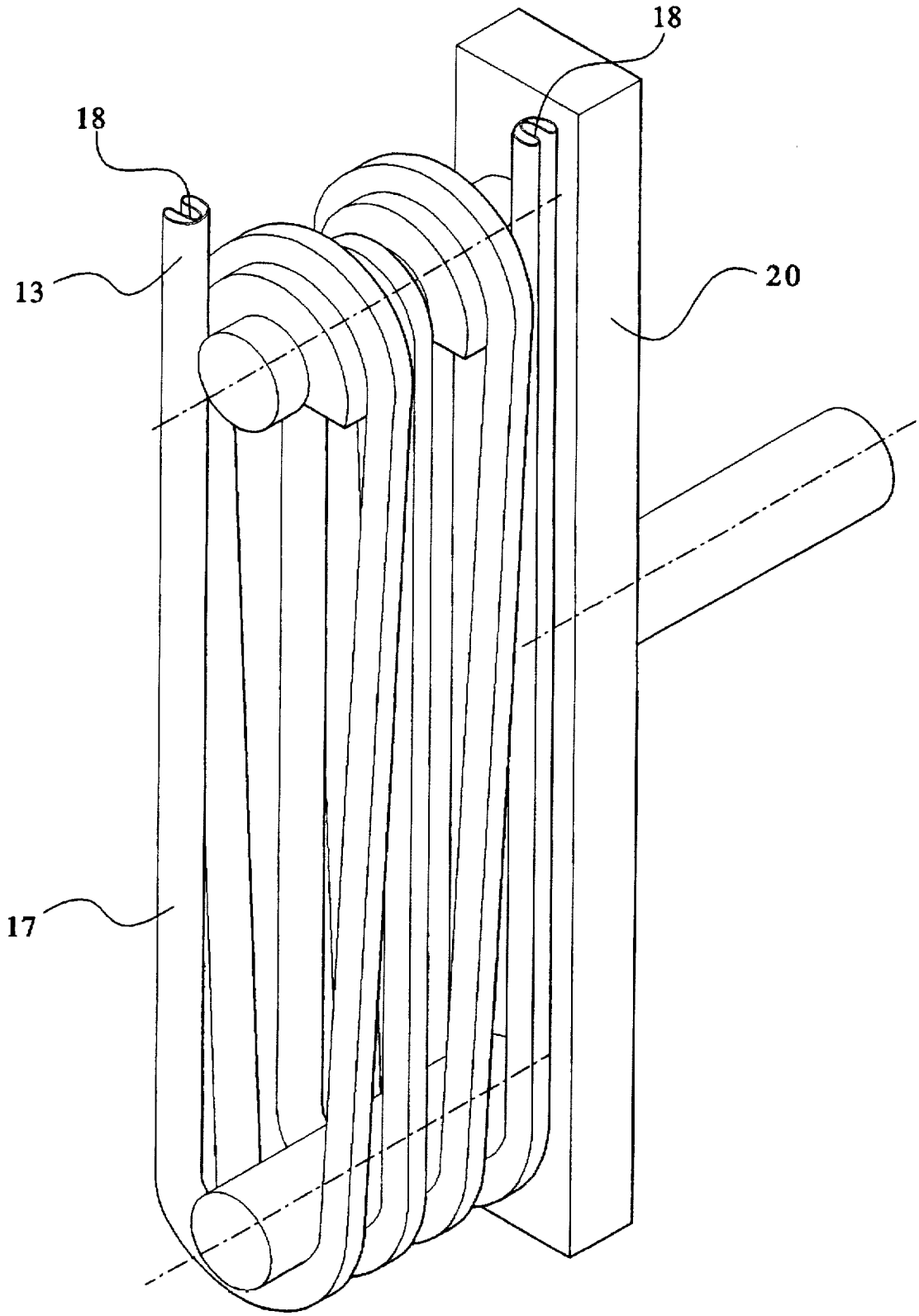
FIG. 4 is the heat exchanger tube of FIG. 2 continuously wrapped on the mandrels of FIG. 3 in accordance with the present invention.

In FIG. 2, the thin-walled heat exchanger tube 12 is passed through a forming mechanism compressing means or Yoder style rolling mill 15 having a forming cavity in the die 15*c* which cooperates with a compression wheel or member 15*b* to provide an elongated tube 13 having a collapsed side-wall 16 (FIG. 2A) extending substantially the length of the tube 13. The cross-section of the collapsed elongated tube 13 provides an elongated recess, channel or opening 18 extending substantially the length of the heat exchanger tube, as also shown in FIG. 2A. The effect of compressing and collapsing the tubing 12 to create an elongated recess or opening 18 within the folded tube 13 extending the length of the tubing provides that the effective diameter of the collapsed heat exchanger tube 13 has been reduced while at the same time the effective wall thickness 14 has been increased. Such a tube structure permits the bending of the folded tube 13 having a smaller diameter, about a multiple diameter mandrels 20 with the sidewall 16 preventing the collapse of the tubing in the bend area. Accordingly, by reducing the effective diameter of the tube 13 while increasing the effective wall thickness of the tube, smaller mandrels 20 may be used for bending the heat exchanger tube into the desired serpentine coil. Also, such a structure permits the bending of collapsed tubes having a wall thickness of as little as 0.014 inches around mandrels of ½ inch or less. This provides a coil, according to the method of the present invention, containing tubes as close together in the plane of bending of ½ inch or less instead of the ⅝ inches or greater, as is true of existing heat exchanger assemblies, as the mandrel set 20 turns in a rotary fashion, as shown in FIG. 3. The folded tubing 13 exiting from the rolling mill 15 possessing the structural shape shown in FIG. 2A, and is then wrapped about the mandrels 20 with the open space 18 of the collapsed tube away from the mandrel surfaces 20*a*, as shown in FIG. 4. The rolling mill predeterminately controls the location of the open space on the collapsed tube so that the tube is properly positioned relative to the mandrel it will be wound around during the manufacture of the serpentine heat exchanger tube.

In effect, as shown in FIG. 4, the collapsed tube 13 having the elongated opening 18 therein is fed onto the multiple diameter mandrel assembly 20, with the opening 18 always on the outside of the mandrel surface 20*a* because the bending of heavier walled tubes having a smaller diameter becomes easier to do without collapse of the tubing in the bend area. By reducing the effective diameter and increasing the effective wall thickness in this manner, smaller mandrels may be used for bending. Typically, under previous methods of manufacture, a 5/16 inch outside diameter tube with a 0.022 inch wall thickness would collapse and be unusable. As pointed out above, the method of the present invention achieves an increase of tube density in a given coil of up to 20 per cent over conventional available coils. Also, it should be noted in accordance with the present invention, given dimensions are proportionate for various tube diameters and wall thicknesses of tubing and that this invention covers all ranges of diameters and wall thickness.

It is an aspect of the present invention that at least one end of the heat exchanger tubing 12 not be folded in the manner heretofore described. The purpose for leaving at least one end in the as-extruded round shape is that it permits for the simple hookup with a pressure fitting when the time for reinflation occurs.

As pointed out above, FIG. 4 shows the preferred manner of wrapping of the folded tube about the mandrel surfaces 20*a*. The opening 18 of the folded tube 13 should be oriented away from the mandrel itself to permit the tube in the inflation mode to "open" back outwardly to its original round or nearly round state. Also, in accordance with the present invention, the elongated inwardly fold sidewall, identified as 16 in the drawings, preferably touches or comes in close contact with the opposite sidewall 16*a* of the tube 13. The purpose for this is to prevent the portion of the tube that is in actual contact with the mandrel during bending from forming a "cave" or "dent" by displacement away from the mandrel. Such "caves" or "dents" will generally not re-round themselves during reinflation of the tubing process. The inward fold sidewall 16 of the tube 13 being in contact with the sidewall 16*a* which touches the mandrel surfaces 20*a* has the effect of reinforcing the tube wall against such caving or denting during wrapping and thus increases the apparent or effective wall thickness for the purpose of bending.

As shown in FIGS. 3 and 4, some of the return bends have different radii than others of the return bends. The purpose for these differing sized bend radii is to allow the tubing to be positioned in latter processing for variable tube spacing or for "jumpers" or other reasons to allow the finished coil to have tubes in almost any position within the finished heat exchanger assembly. FIG. 4, also shows a proposed tube layout that might use variable tube spacing for the purpose of catching frost in a frost-free refrigerator, for example.

Figure 5:
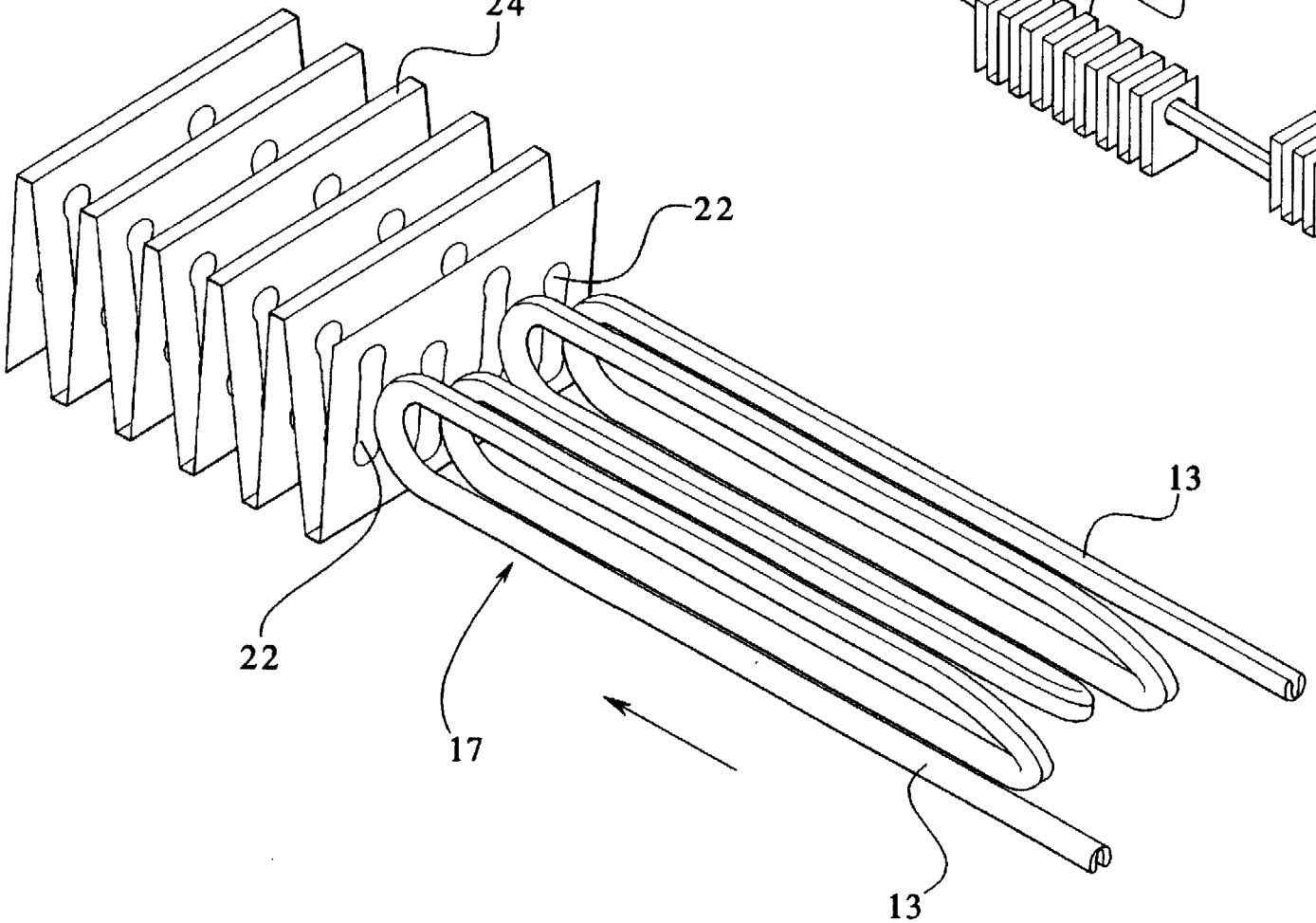
FIG. 5 illustrates the collapsed serpentine-type heat exchanger tube formed in FIG. 4 during insertion into openings in a fin set or array in accordance with the present invention.

FIG. 5, illustrates the spirally wrapped serpentine-type tube 17 containing the elongated opening 18 therein having been removed from the mandrels and being inserted into slots or fin holes 22 in the fin set or array 24. Unlike the prior art, the uninflated folded serpentine-type tube 17 of the present invention has a smaller diameter than the slots or fin holes 22 of the fin set or array 24 into which it is being inserted. Consequently, it is unnecessary to have collars or any other devices to facilitate the easy slippage or positioning of the serpentine-type tube 17 into the slots or fin holes, as is necessary with previously known methods of manufacture. Thus, in accordance with the present invention, the elongated folded or collapsed serpentine-type tube 17 may more easily be inserted into the fin set array than with other methods of manufacture. It is a further part of this invention that the "dog-bone" slots or fin holes 22 (FIG. 5) through which the serpentine return bends must be slid may be narrower than has previously been required, thus yielding greater fin surface area in the finished heat exchanger assembly. Also, the folded serpentine-type tube 17 being stiffer because of cold working may be more easily slid into the fin slots or fin holes 22.

Figure 6:
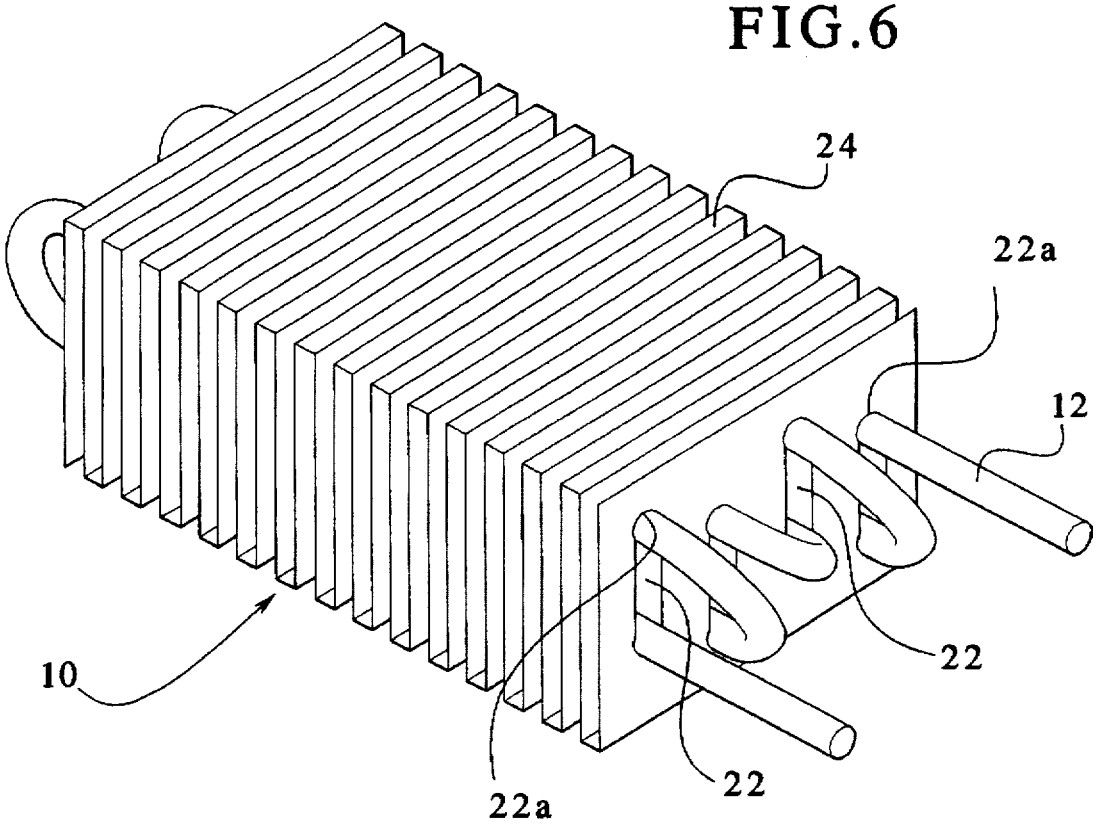
FIG. 6 illustrates the serpentine heat exchanger tube of FIG. 5 after expansion to engage the fin set or array using internal pressure means in accordance with the present invention.

FIG. 6 illustrates the serpentine-type tube 12 and resultant heat exchanger assembly 10 after reinflated to a new configuration, in this case, substantially round. In this process, the expanded tube sidewall 16 comes into intimate contact with the fin sets or array 24 and locks the array into contact with the expanded tube to produce an excellent tube-to-fin bond and consequently excellent heat transfer properties. The reinflation process is extremely fast and inflation of the collapsed serpentine tube 13 at one point will not move the fin sets or array away from the tubing because there is not enough time for the mass of the fin to accelerate and produce movement away from the expanding tube. When the folded tube is positioned and held in the proper orientation with respect to the slots or fin holes 22 in the fin sets or array 24, the inflation of the folded tube 13 causes the expanded tube to conform to the geometry of the fin slots or fin holes.

Figure 7:
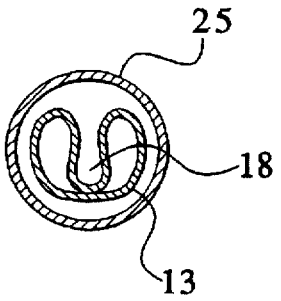
FIG. 7 is a tube within a tube cross-section illustrate the insertion of the collapsed tube within a round tube of a larger diameter in accordance with a further embodiment of the present invention.
Figure 7A:
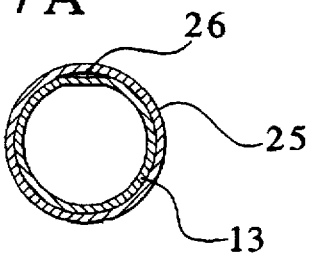
FIG. 7A is the tube within a tube as depicted in FIG. 7 after expansion of the inner collapsed tube using internal pressure means in accordance with the present invention.

FIGS. 7 and 7A shows a further embodiment of the present invention where a tube-in-tube arrangement is illustrated wherein the collapsed tube 13 has been inserted into a straight tube 25 having a larger surface diameter and then re-inflated to form a good tight bond between the outside of the collapsed tube and the inner surface of the straight tube 25. Both tubes together can then be serpentined and finned by conventional methods. This embodiment provides a shield for the interior tube, which has heretofore not been possible in manufacturing shielded interior tubes. Thus, an important aspect of the present invention is that upon re-inflation, the elongated opening 18 of the tube 13 does not fully re-expand to the round shape, thus providing a small elongated port 26 between the walls of the two tubes. This elongated port 26 may be used by escaping gases should the interior refrigerant containing tube 13 develop a leak. This design is of particular value in the design of refrigeration systems using combustible refrigerants.

Figure 8:
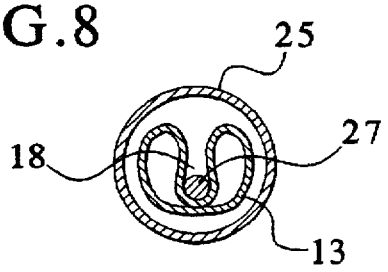
FIG. 8 is a tube within a tube as shown in FIG. 7 further including an elongated heating wire positioned within the elongated opening provided by the collapsed thin-walled heat exchanger tube in accordance with a further embodiment of the present invention.
Figure 8A:
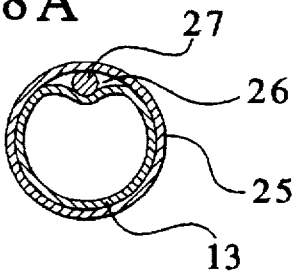
FIG. 8A is the tube within a tube and heating wire as depicted in FIG. 8 after expansion of the inner collapsed tube using internal pressure means in accordance with the present invention.

FIGS. 8 and 8A illustrate a further embodiment of the present invention of the tube-in-tube arrangement as shown in FIGS. 7 and 7A, wherein an elongated heating wire 27 is positioned within the elongated opening 18 of the collapsed or folded tube 13. As set forth above with respect to FIGS. 7 and 7A, upon reinflation, the elongated opening 18 of the collapsed tube 13 does not fully re-expand to the round shape, thus depositing the heating wire 27 within the elongated port 26 between the walls of the tubes. Such a structure permits placing the heating wire within the heat exchanger tubes to position the heat adjacent the fin sets or array, the source of the frost. This structure readily accomplishes defrosting of such heat exchanger assembles while utilizing reduced power consumption.

Figure 9:
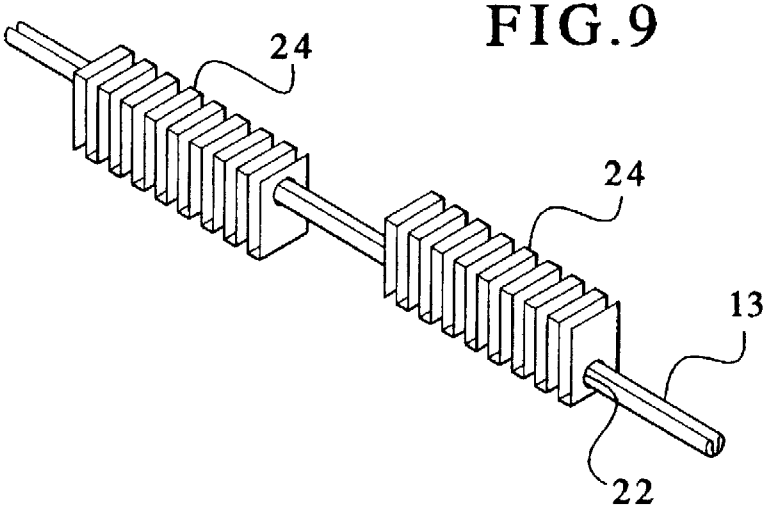
FIG. 9 is a perspective view of the collapsed or folded heat exchanger tube of FIG. 2 being inserted through individual fin sets or arrays associated with each pipe of a heat exchanger assembly.
Figure 9A:
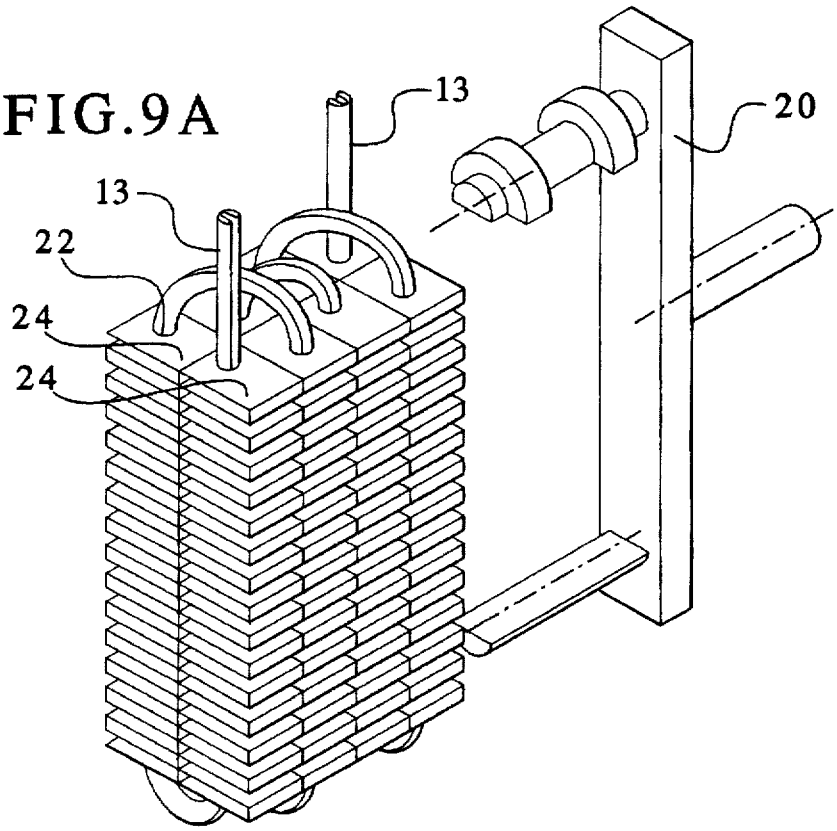
FIG. 9A illustrates a heat exchanger assembly of the heat exchanger tube of FIG. 9 continuously arranged on mandrels in accordance with the present invention.
Figure 9B:
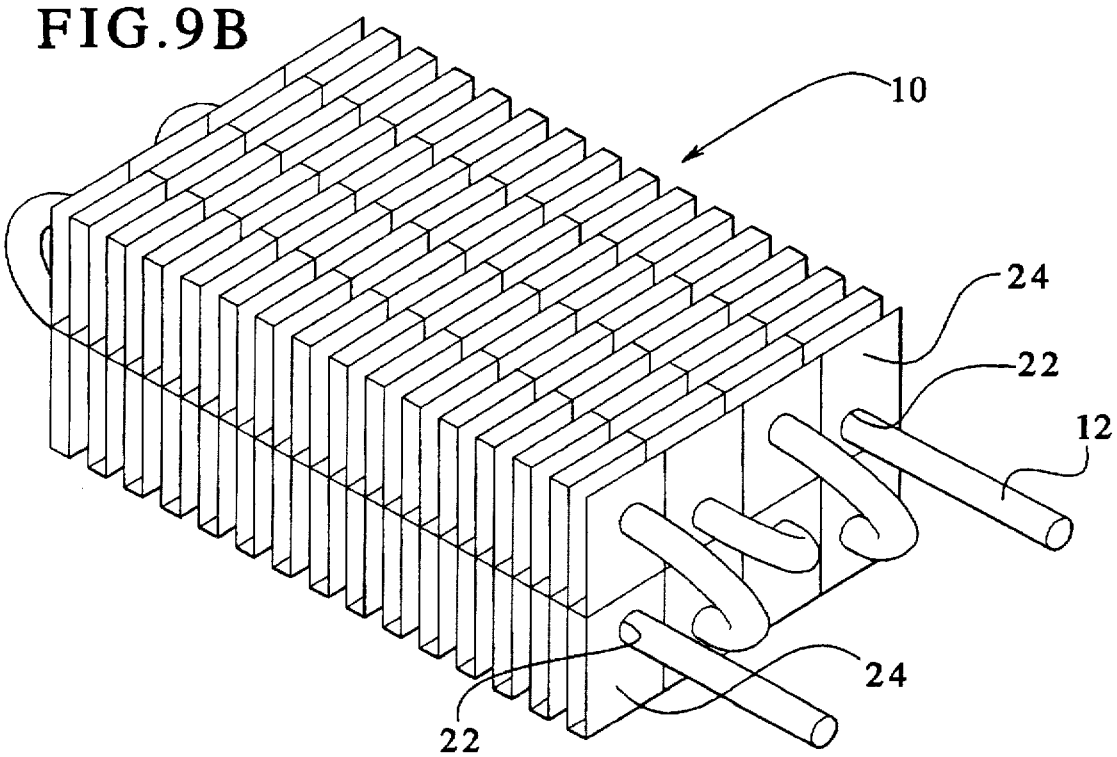
FIG. 9B illustrates the finished heat exchanger assembly of FIG. 9A after air expansion utilizing internal pressure means to expand the collapsed tube to engage and be locked to the fin sets or arrays in accordance with the present invention.

FIGS. 9–9B illustrates an alternate type of finished heat exchanger assembly 10 wherein individual folded fin sets or arrays 24 have been predeterminately positioned on the elongated folded tube 13 (FIG. 9) by inserting the elongated collapsed tube through fin holes 22 in the arrays 24 and then having the tubes containing fin sets bent around mandrels 20 (FIG. 9A) prior to reinflation of the tubes. The process of reinflation captures and secures the individual fins to the tubes, as shown in FIG. 9B, to complete the heat exchanger assembly 10. In this embodiment of the present invention, it is also possible to have various forms of "collars" to increase the tube to fin contact thus decreasing the resistance of the heating flux between the tube and the fin. The method of using the folded and reinflated tube containing fin sets therein permits the heat exchanger designer greatly increased flexibility not only in design of the tube layout but also the fin shape and placement of the array within the finished coil. Also, in such assemblies, both thinner fins and thinner tube walls are possible than have been used in the prior art because the fins do not support the expanded tubes or pipes.

In accordance with the present invention, a novel method for making a heat exchanger assembly is disclosed which includes the steps of passing a thin-walled heat exchanger tube through a folding mechanism to provide an elongated tube having a collapsed sidewall extending substantially the length of the tube. The elongated collapsed heat exchanger tube is then rotated about either a multiple diameter or constant diameter forming mandrel to provide a spirally wrapped serpentine heat exchanger tube. The spirally wrapped serpentine heat exchanger tube is aligned with a heat transfer array having first and second parallel fin surfaces with each paralled surface having aligned openings therein. The spirally wrapped and formed serpentine heat exchanger tube is then inserted into the openings in the heat transfer array and then re-expanded to move the collapsed heat exchanger tube outwardly to cause the tube to engage and contact with the fin surfaces to capture and secure the individual fins to the expanded tube to complete the heat exchanger assembly.

Additionally, it is within the scope of the present invention that the method of making heat exchanger assemblies includes individual folded fin sets or arrays having openings therein that are specifically positioned on the elongated collapsed heat exchanger tube. The specifically mounted fin sets and corresponding tube are then bent around the mandrel to provide a serpentine-type like heat exchanger assembly. The formed elongated serpentine-type collapsed heat exchanger tube is then reinflated to engage and be secured to the individual fin surfaces of the fin set array to complete the heat exchanger assembly. This method permits the heat exchanger designer increased flexibility in the design of the tube layout as well as the placement of the placement of the array within the finished coil assembly.

Also, the method of making heat exchanger assemblies includes the use of single or multiple heat transfer fin sets or arrays that are accordion-like sheets of heat radiating material folded back and forth upon itself. The junction between the folded sheets of the array material may include slots or notches which cooperate to be engaged by a single length of collapsed heat exchanger tube that is spirally wrapped around the array to engage the slots or notches to form the heat exchanger assembly. The heat exchanger assembly is completed by reinflating the collapsed tube to secure the tube to the array or arrays, to provide a heat exchanger assembly, substantially in accordance with the teachings of U.S. Pat. No. 4,778,004, assigned to the assignee of the present invention, which teaching is incorporated herein.

Although the present invention has been disclosed as utilizing a multiple diameter forming mandrel to provide the spirally wrapped serpentine-type heat exchanger tube, the forming mandrel may also be of a constant diameter to provide the wrapped heat exchange tube. Moreover, the forming mandrel may have a configuration that is rectangular in form or multiple-sided in form to permit the manufacture of various geometric coil configurations, as desired.

We claim:

1. A method of making an elongated tube for use in a heat exchanger assembly of the side-entry type, including the steps of:

extruding an elongated tube having a substantially circular cross-section;

cutting the extruded elongated tube to the desired length of the finished heat exchanger assembly; and passing the cut extruded tube through a folding mechanism to provide an elongated tube having a collapsed sidewall extending substantially the length of the elongated tube.

2. The method in accordance with claim 1 wherein said extruded elongated tube has a wall thickness of between about 0.010 to 0.030 inches.

3. The method in accordance with claim 1 wherein said extruded elongated tube is comprised of aluminum.

4. The method in accordance with claim 1 wherein said folding mechanism engages the cut elongated tube to provide said collapsed sidewall substantially engaging the inner wall of the tube.

5. The method in accordance with claim 4 wherein said folding mechanism includes a die having a forming cavity and a compression member which engages said cut extruded tube.

6. A method of making a heat exchanger assembly including a thin-walled heat exchanger tube and at least one fin set having fin holes, including in combination:

passing the thin-walled heat exchanger tube through a folding mechanism to provide an elongated tube having a collapsed sidewall portion extending substantially the length of the tube;

rotating the elongated collapsed heat exchanger tube about a forming mandrel having a mandrel outer surface while maintaining and positioning said collapsed portion opposite said mandrel outer surface to provide a spirally wrapped serpentine heat exchanger tube;

aligning said spirally wrapped serpentine with the fine holes of said at least one fin set; and expanding said collapsed sidewall portion of the heat exchanger tube to secure the fin set to the expanded thin-walled heat exchanger tube to provide the heat exchanger assembly.

7. The method in accordance with claim 6 wherein said thin-walled elongated heat exchanger tube has a wall thickness of between about 0.010 to 0.030 inches.

8. The method in accordance with claim 6 wherein said mandrel outer surface has a multiple diameter to provide return bend portions of said spirally wrapped serpentine heat exchanger tube having different radii.

9. The method in accordance with claim 6, wherein said mandrel outer surface has a uniform diameter to provide the return bend portions of said spirally wrapped serpentine heat exchanger tube having substantially the same radii.

10. The method in accordance with claim 6 wherein said method further includes the step of inserting said elongated heat exchanger tube having a collapsed sidewall within an outer substantially circular heat exchanger tube to permit expanding of said tube having a collapsed sidewall to form a bond between the heat exchanger tubes.

11. The method in accordance with claim 10 wherein said step of expanding of said tube having a collapsed sidewall is within said outer tube to provide an elongated port extending the length between the walls of the bonded tubes.

12. The method in accordance with claim 11, wherein said elongated heat exchanger tube having a collapsed sidewall includes a heating wire positioned along its length therein such that the expanding of the collapsed sidewall tube within said outer tube positions said heating wire within said elongated port between the heat exchanger tubes.

13. A method of making a heat exchanger assembly including a thin-walled heat exchanger tube and at least one fin set having fin holes therein, including in combination:

passing the thin-walled heat exchanger tube through a folding mechanism to provide an elongate tube having a collapsed sidewall portion extending substantially the length of the tube;

inserting said thin-walled heat exchanger tube having a collapsed sidewall portion through said holes of said at least one fin set, to position said at least one fin set on said tube;

rotating the elongated collapsed heat exchanger tube and said associated at least one fin set about a forming mandrel outer surface to provide a spirally wrapped serpentine heat exchanger tube and associated fin set; and expanding said collapsed sidewall portion of the heat exchanger tube to secure the at least one fin set to the expanded thin-walled heat exchanger tube to provide the heat exchanger assembly.

14. The method in accordance with claim 13 wherein said thin-walled heat exchanger tube has wall-thickness of between about 0.010 to 0.030 inches.

15. The method in accordance with claim 13 wherein said folding mechanism includes a die having a forming cavity and a compression member which engages said cut extruded tube.

16. A method of making a heat exchanger assembly including a thin-walled heat exchanger tube and at least one fin set having fin holes therein, including in combination:

passing the thin-walled heat exchanger tube through a folding mechanism to provide an elongated tube having a collapsed sidewall portion extending substantially the length of the tube;

inserting said tube having a collapsed sidewall portion within an outer substantially circular heat exchanger tube;

positioning said thin-walled heat exchanger tube having a collapsed sidewall portion and said outer tube through said holes of said at least one fin set, to position said at least one fin set on said outer tube;

rotating the elongated collapsed heat exchanger tube, the outer tube and said associated at least one fin set about a forming mandrel outer surface to provide a spirally wrapped serpentine heat exchanger tube and associated fin set; and expanding said collapsed sidewall portion of the heat exchanger tube within said outer tube to form a bond between the tubes and to secure the at least one fin set to the tubes to provide the heat exchanger assembly.

17. The method in accordance with claim 13 wherein said thin-walled heat exchanger tube has wall-thickness of between about 0.010 to 0.030 inches.

18. The method in accordance with claim 13 wherein said folding mechanism includes die having a forming cavity and a compression member which engages said cut extruded tube.

19. The method in accordance with claim 16 wherein said step of expanding of said tube having a collapsed sidewall within said outer tube provides an elongated port extending the length between the walls of the bonded tubes.

20. The method in accordance with claim 19 wherein said method further includes the step of positioning a heating wire along the collapsed sidewall portion prior to inserting said collapsed tube with said outer tube such that during the expanding step the collapsed sidewall tube positions said heating wire within said elongated port between the heat exchanger tubes.

21. A method of making a heat exchanger assembly including a thin-walled heat exchanger tube and at least one fin set wherein the at least one fin set is an accordion-like sheet of heat radiating material folded back and forth upon itself and having fin slots at the junction of each fold, including in combination:

passing the thin-walled heat exchanger tube through a folding mechanism to provide an elongated tube having a collapsed sidewall portion extending substantially the length of the tube;

spiral wrapping the elongated collapsed heat exchanger tube about a forming mandrel and said at least one fin set to engage said spirally wrapped serpentine heat exchanger tube with said slots of said at least one fin set; and expanding said collapsed sidewall portion of the heat exchanger tube to secure the fin set to the expanded spiral wrapped thin-walled heat exchanger tube to complete the heat exchanger assembly.

22. The method in accordance with claim 21 wherein said thin-walled heat exchanger tube has a wall-thickness between about 0.010 to 0.030 inches.

23. The method in accordance with claim 21 wherein said mandrel outer surface has a multiple diameter to provide return bend portions of said spirally wrapped serpentine heat exchanger tube having different radii.

24. The method in accordance with claim 21 wherein said mandrel outer surface has a uniform diameter to provide the return bend portions of said spirally wrapped serpentine heat exchanger tube having substantially the same radii.

25. The method in accordance with claim 21 wherein said folding mechanism includes a die having a forming cavity and a compression member which engages said cut extruded tube.

26. A method of making a heat exchanger assembly including a thin-walled heat exchanger tube and at least one fin set wherein the at least one fin set is an accordion-like sheet of heat radiating material folded back and forth upon itself and having fin slots at the junction of each fold, including in combination:

passing the thin-walled heat exchanger tube through a folding mechanism to provide an elongated tube having a collapsed sidewall portion extending substantially the length of the tube;

inserting said tube having a collapsed sidewall portion within an outer substantially circular heat exchanger tube;

wrapping the elongated collapsed heat exchanger tube and said outer tube about a forming mandrel and said at least one fin set to engage said spirally wrapped serpentine heat exchanger tubes with said slots of said at least one fin set; and expanding said collapsed sidewall portion of the heat exchanger tube within said outer tube to secure the at least one fin set to the serpentine heat exchanger tubes to complete the heat exchanger assembly.

27. The method in accordance with claim 26 wherein said thin-walled heat exchanger tube has a wall-thickness between about 0.010 to 0.030 inches.

28. The method in accordance with claim 26, wherein said mandrel outer surface has a multiple diameter to provide return bend portions of said spirally wrapped serpentine heat exchanger tubes having different radii.

29. The method in accordance with claim 26 wherein said mandrel outer surface has a uniform diameter to provide the return bend portions of said spirally wrapped serpentine heat exchanger tubes having substantially the same radii.

30. The method in accordance with claim 26 wherein said folding mechanism includes a die having a forming cavity and a compression member which engages said cut extruded tube.

* * * * *

UNITED STATES PATENT AND TRADEMARK OFFICE

CERTIFICATE OF CORRECTION

PATENT NO. : 5,704,123

DATED : January 6, 1998

INVENTOR(S) : Roger Paulman and A. Todd McKay

It is certified that error appears in the above-identified patent and that said Letters Patent is hereby corrected as shown below:

Column 4, line 21 change "illustrate" to --illustrating--.

Column 5, line 44 change "possessing" to --possesses--.

Column 6, line 2 change "diameters" to --diameter--.

Column 6, line 32 change "latter" to --later--.

Column 7, line 43 change "9-9B" to --9A-9B--.
line 57 change "therein" to --thereon--.

Signed and Sealed this

Eighth Day of June, 1999

*Attest:*

Q. TODD DICKINSON

*Attesting Officer*

*Acting Commissioner of Patents and Trademarks*